US005990828A

United States Patent [19]

King

[11] Patent Number: 5,990,828

[45] Date of Patent: Nov. 23, 1999

[54] DIRECTIONAL GARAGE DOOR OPENER TRANSMITTER FOR VEHICLES

[75] Inventor: Joseph David King, Ann Arbor, Mich.

[73] Assignee: Lear Corporation, Southfield, Mich.

[21] Appl. No.: 09/088,987

[22] Filed: Jun. 2, 1998

[51] Int. Cl.[6] ..... H01Q 3/00; G08C 19/17

[52] U.S. Cl. ..... 342/359; 341/176; 49/25

[58] Field of Search ..... 342/357.08, 359, 342/367; 49/25; 341/176

[56] References Cited

U.S. PATENT DOCUMENTS

| | | | |
|---|---|---|---|
| Re. 35,364 | 10/1996 | Heitschel et al. | 364/900 |
| 4,263,539 | 4/1981 | Barton | 318/664 |
| 4,621,266 | 11/1986 | LeGall et al. | 342/359 |
| 4,725,843 | 2/1988 | Suzuki et al. | 342/359 |
| 4,808,995 | 2/1989 | Clark et al. | 340/825.69 |
| 4,841,303 | 6/1989 | Anderson | 342/359 |
| 5,247,440 | 9/1993 | Capurka et al. . | |
| 5,281,970 | 1/1994 | Blaese | 341/176 |
| 5,521,604 | 5/1996 | Yamashita | 342/359 |
| 5,583,514 | 12/1996 | Eulop | 342/359 |
| 5,689,236 | 11/1997 | Kister | 340/545 |
| 5,828,964 | 10/1998 | Needle | 455/500 |
| 5,854,609 | 12/1998 | Pyo et al. | 342/359 |

*Primary Examiner*—Mark Hellner
*Attorney, Agent, or Firm*—Niro, Scavone, Haller & Niro

[57] ABSTRACT

A garage door opener transmitter system includes a sensor for determining the relative direction of the garage door opener receiver. A transmitter then selectively transmits a signal in the direction of the receiver. In one embodiment, the direction of the receiver is determined based upon a compass and the direction of travel of the vehicle at the time the signal is transmitted.

25 Claims, 1 Drawing Sheet

DIRECTIONAL GARAGE DOOR OPENER TRANSMITTER FOR VEHICLES

BACKGROUND OF THE INVENTION

The present invention relates generally to a wireless transmitter for a vehicle and more particularly to a directional garage door opener for a vehicle.

The majority of new homes built are being constructed with garage door openers with remote controllers using RF wireless technology. Many existing homes are also being upgraded with garage door openers using RF wireless technology for accomplishing the remote function. The current trend in the automotive market is to provide new vehicles with factory installed universal garage door opener transmitters. Due to the combined effects of such design variables as the vehicle itself distorting the radiation pattern of a garage door opener transmitter, the Faraday cage surrounding a garage door opener receiver located in a garage, and the low DC power requirements, the operating range between the vehicle garage door opener transmitter and the receiver located in the garage, is extremely limited. In some cases, the range is only 20–30 feet.

Consumers demand ranges approaching several hundred feet so that they can operate the garage door opener several hundred feet from the closed garage door while "on the fly" so that the garage door will be fully open when they arrive at the garage. The several hundred foot range must also exist in all directions. This is desirable for closing the garage door when leaving the garage, especially, when the consumer attempts to close the door when they are at the end of the driveway, or down the street.

Transmitters for garage door openers are designed to have uniform range in all directions to satisfy the previously stated requirements. The tradeoff is to have a higher power transmitter and antenna system that radiates equally in all directions. A higher power transmitter also increases system cost.

SUMMARY OF THE INVENTION

The present invention provides a garage door opener transmitter system which transmits a focused wireless signal in a calculated relative direction of the garage door opener receiver. The garage door opener transmitter system includes a sensor for determining a relative direction between the transmitter and the receiver and a beam steerer for directing the signal from the transmitter in the relative direction.

In one embodiment, the sensor is a compass. The garage door opener transmitter system is first placed in a "learn mode" while the vehicle is in the driveway facing the garage door opener receiver. This geographic direction as determined by the compass is recorded. Later, in operation mode, as the vehicle approaches the garage door opener receiver in the street, the system determines the relative direction of the garage door opener receiver. This direction may be an average between the learned geographic direction of the receiver (relative to the driveway) and the direction of travel of the vehicle at the time the garage door opener button is pressed. The transmitter then transmits a wireless signal which is steered in the relative direction of the garage door opener receiver.

As a result, opening of the garage door can be initiated while the vehicle is approaching the driveway in the street at a distance which will permit the garage door to be completely open by the time the vehicle arrives at the garage. Because the wireless signal is focused in the proper relative direction of the receiver, a high power transmitter is not required. Due to the narrower beam width of the antenna beam, much higher directive gain is achieved, thereby allowing for use of a lower power transmitter.

DETAILED DESCRIPTION OF THE PREFERRED EMBODIMENT

Figure 1:
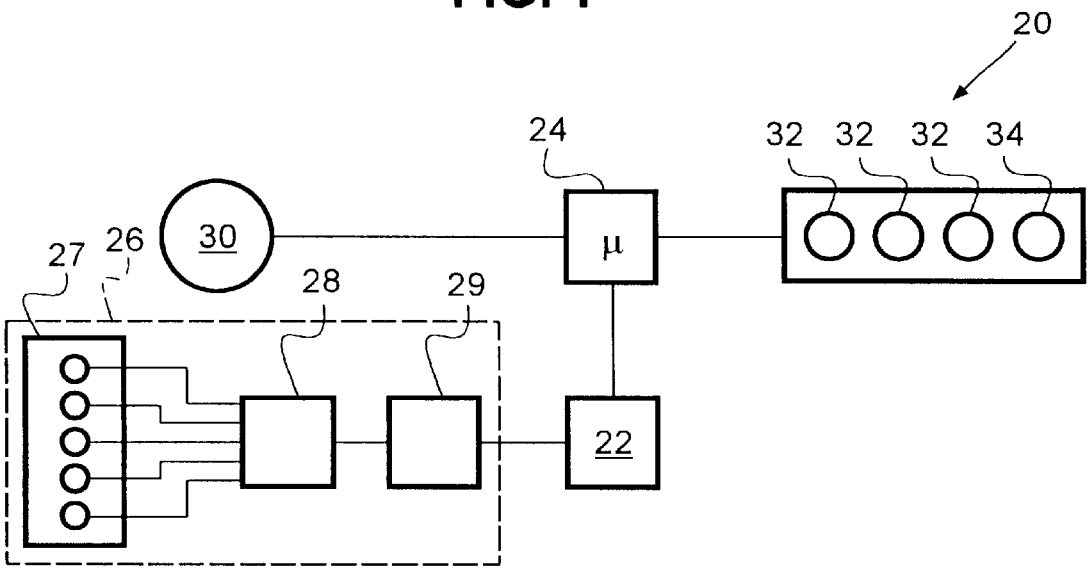
FIG. 1 is a schematic of the garage door opener transmitter system of the present invention.

A garage door opener transmitter system 20 of the present invention is shown schematically in FIG. 1. The garage door opener transmitter system includes a transmitter 22, such as an RF transmitter. As is well known, the transmitter 22 transmits a signal comprising codes and/or information, which may be encrypted or rolled, according to known techniques. The transmitter system 20 may include a controller 24, such as a microprocessor with appropriate software or hardwired circuitry to perform the functions described herein.

A beam steerer 26 includes an antenna array 27, a beam former 28 (Rotman lens or phase shifters) and a switching network 29 (or power dividers). The beam steerer 26 is connected to the transmitter 22. The beam steerer 26 can selectively direct the signal from the transmitter 22 and focus the signal in a selected direction. The technology and techniques for developing and steering an antenna beam (e.g. a microstrip Rotman Lens with a linear array or phaseshifters and an antenna array) are well documented and understood. Three linear antenna arrays 27 (one shown) may be arranged in a triangle configuration to provide the ability to direct the beam in any (360 degrees) direction.

A sensor 30, such as a compass, is connected to the controller 24. As will be described in more detail below, the sensor 30 may alternatively comprise one or more elements of a vehicle navigation system, such as a GPS receiver or dead reckoning system. One or more user activated buttons 32 are connected to the controller 24 to selectively cause the transmitter 22 to send selectively any one of a plurality of signals. A user-activated learn mode button 34 is also connected to the controller 24 and its function will be described below.

Figure 2:
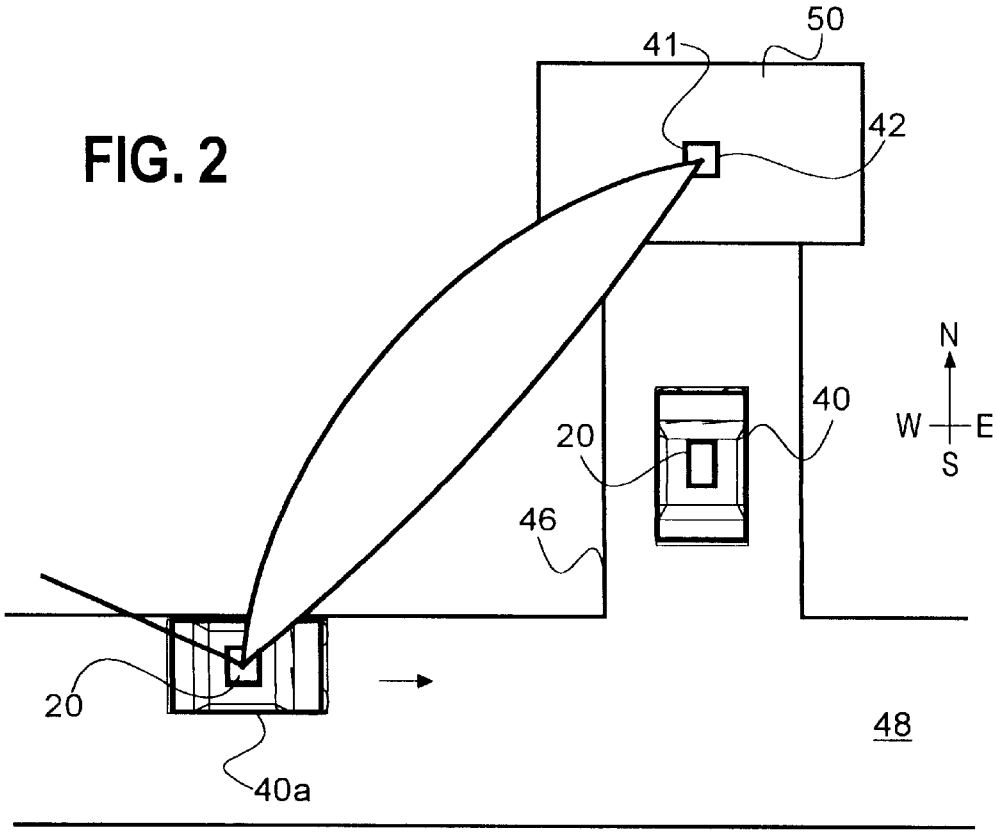
FIG. 2 illustrates the operation of the garage door opener transmitter system of FIG. 1.

The operation of the first embodiment, in which the sensor 30 is a compass or other device which provides only geographic direction, will be described referring to FIG. 2. In this embodiment, the garage door opener transmitter system 20 is mounted in a known orientation in a vehicle 40. A garage door opener 41 with a receiver 42 to be operated by the garage door opener transmitter system 20 is at an end of a driveway 46 leading from a street 48 toward a garage 50. The vehicle 40 is first positioned in the driveway 46 oriented with the rear of the vehicle 40 toward the street 48 and the front of the vehicle 40 toward the garage door opener receiver 42. The sensor 30 records this geographic direction (in this example, North) in which the vehicle is oriented in response to a user-initiated action such as pressing the learn mode button 34. The controller 24 then stores this direction as the direction of the receiver 42 relative to the street 48.

Subsequently, in operation mode, when a vehicle 40*a* is travelling on the street 48 toward the driveway 46 and a button 32 is activated, the system 20 determines the current vehicle heading (East). The system 20 then determines the direction of the receiver 42 relative to the vehicle 40*a* as an average between the relative geographic direction between the street 48 and the receiver 42 stored during learning mode (North) and the direction the vehicle is currently heading (East). The result is the current relative direction of the receiver 42 relative to the vehicle 40*a* (Northeast). The transmitter 22 then transmits the signal that the beam steerer 26 steers in the relative direction (Northeast) by focusing the signal in that direction. As a result, the radiated signal power from the transmitter 22 is focused in the proper direction toward the receiver 42 and can be transmitted from a larger distance, without increasing the power requirement of the transmitter 22.

The stored geographic relative direction between the receiver 42 and the street 48 stored in learning mode will indicate a first vector or relative direction between the receiver 42 and the driveway 46. When a switch 32 is activated while the vehicle 40 is in the street 48, the direction that the vehicle 40 is facing indicates a vector which is the relative direction of the vehicle 40 and the driveway 46. The resultant vector will be the relative direction between the vehicle 40 and the receiver 42.

If the vehicle were travelling west on the street 48 toward the driveway 46 when the user presses the button 32 to open the garage door, the vehicle direction would be West and the resultant or average relative direction between the vehicle 42 and the receiver 42 would be Northwest. Other algorithms could also be used to include dead reckoning. For example, the magnitude of the angular difference between the learned heading and the vehicle heading could be subtracted from or added to the vehicle heading to determine the relative direction of the receiver 42.

A slightly different algorithm would be utilized to close the garage door, since the vehicle 40 would be travelling away from the receiver 42. One way of accomplishing this is to utilize the direction opposite the direction of vehicle 40 travel for combining with the learned geographic direction.

It should also be recognized that if the garage 50 were positioned adjacent the driveway 46, the vehicle 40 should be positioned in the driveway 46 in the direction perpendicular to the street 48 in learning mode, in order to store the correct vector. Further, it should be recognized that the beam steerer could be replaced with a plurality of individual directional antennas used in conjunction with a switching network 29, which could be strategically placed on or in the vehicle 40.

In another embodiment, the sensor 30 comprises a position system which indicates the current position of the vehicle at the time the user switch 32 is activated. For example, the sensor 30 may be a vehicle navigation system or a component or several components of a vehicle navigation system, such as a GPS receiver, dead-reckoning system, and map-matching system, which are all well known. If the sensor 30 provides position of the vehicle 40 relative to earth (such as by GPS, navigation system, dead reckoning, etc), then the relative direction between the vehicle 40*a* and the receiver 42 can be determined by comparing the position of the vehicle 40*a* as determined by the sensor 30 and a stored position of the receiver 42. The position of the receiver 42 would be stored in learning mode by positioning the vehicle 40 in or adjacent the garage 50 and storing the present position of the vehicle 40. This feature could be used in combination with another invention of the applicant, which is more fully described in co-pending application U.S. application Ser. No. 09/088,933 filed concurrently herewith entitled "PASSIVE GARAGE DOOR OPENER" the assignee of which is the assignee of the present invention.

It should be recognized that other transmitters, such as infrared, microwave, etc. could also be utilized, with appropriate beam steerers 26.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A transmitter system for a vehicle comprising:

a transmitter for transmitting a wireless signal for actuating a receiver that is remote from the vehicle and operates a device associated with the receiver in response to said wireless signal;

a sensor for determining a relative direction between the vehicle and the receiver; and a signal-directing device for directing said wireless signal in said relative direction.

2. The transmitter system of claim 1 wherein said sensor includes a compass.

3. The transmitter system of claim 1 further including a learn mode storing information from which said relative direction can be determined.

4. The transmitter system of claim 1 wherein said relative direction is determined based upon a travel direction of the vehicle.

5. The transmitter system of claim 4, wherein said relative direction is determined based upon said travel direction and a geographic direction.

6. The transmitter system of claim 5, wherein said geographic direction is determined by a compass.

7. The transmitter system of claim 1, wherein said signal-directing device includes a beam steerer.

8. The transmitter system of claim 1 wherein said sensor determines a travel direction of said vehicle, said relative direction determined based upon said travel direction and a previously-stored relative geographic direction of a street and the receiver.

9. The transmitter system of claim 1 wherein said sensor determines a position of said vehicle, said relative direction determined based upon said position of said vehicle and a previously-stored position of said receiver.

10. The transmitter system of claim 9 wherein said sensor includes a GPS receiver.

11. A method for transmitting a signal from a vehicle including the steps of:

(a) determining a relative direction between a vehicle and a receiver that is remote from the vehicle and operates a device associated with the receiver in response to a wireless signal;

(b) transmitting said wireless signal; and (c) directing said transmitted wireless signal in said relative direction.

12. The method of claim 11 further including the steps of:

d) determining a travel direction of the vehicle;

e) determining said relative direction in said step a) based upon said step d).

13. The method of claim 12 further including the steps of:

f) determining a relative geographic direction between a street and the receiver;

g) determining said relative direction in said step a) between said travel direction and said relative geographic direction.

14. The method of claim 11 further including the steps of:

d) determining a relative geographic direction between a street and the receiver;

e) determining said relative direction in said step a) based upon said step d).

15. The method of claim 11 further including the steps of:

d) determining a position of the vehicle;

e) determining said relative direction in said step a) based upon said step d).

16. The method of claim 15 further including the steps of:

f) determining a position of the receiver;

g) determining said relative direction in said step a) based upon said step f).

17. A wireless transmitter system for operating from a vehicle a device in a dwelling while the vehicle is remote from the dwelling, the system comprising:

means for transmitting a wireless signal;

means for determining a relative direction between the vehicle and a receiver in the dwelling that operates the device in response to said wireless signal; and means for steering said wireless signal in said relative direction.

18. The wireless transmitter system of claim 17 further including:

means for determining a travel direction of the vehicle, said relative direction determined based upon said travel direction.

19. The wireless transmitter system of claim 18 further including:

means for determining a relative geographic direction between a street and the receiver, said relative direction determined based upon said relative geographic direction.

20. The wireless transmitter system of claim 17 further including:

means for determining a position of the vehicle; and means for storing a position of the receiver, wherein said relative direction is determined based upon said position of said vehicle and said stored position of the receiver.

21. The transmitter system of claim 8, wherein said relative direction is determined by averaging the travel direction and the previously-stored relative geographic direction.

22. The method of claim 11, wherein step a) comprises averaging said direction of the vehicle and a previously-stored receiver direction.

23. The wireless transmitter system of claim 17, wherein the device is a mechanism for operating a garage door and said receiver opens and closes the garage door in response to said signal.

24. A transmitter-receiver system for operating from a vehicle a device remote from the vehicle, the system comprising:

a receiver for operating the device in response to a wireless signal with a predetermined characteristic; and a transmitter for transmitting a wireless signal with said characteristic, said transmitter including a sensor for determining a relative direction between said vehicle and said receiver and a signal-directing device for directing said signal in said relative direction.

25. The transmitter-receiver system of claim 24, wherein the device is a mechanism for operating a garage door and said receiver opens and closes the garage door in response to said signal.

* * * * *